US006099140A

United States Patent [19]

Norris

[11] Patent Number: 6,099,140

[45] Date of Patent: Aug. 8, 2000

[54] POCKET LIGHT

[76] Inventor: L. Wayne Norris, 22106 Garmisch Way, Brooksville, Fla. 34301

[21] Appl. No.: 09/264,166

[22] Filed: Mar. 5, 1999

Related U.S. Application Data

[63] Continuation-in-part of application No. 08/991,274, Oct. 21, 1997, abandoned.

[51] Int. Cl.[7] ..... F21L 7/00

[52] U.S. Cl. ..... 362/156; 362/190; 362/191; 362/154

[58] Field of Search ..... 362/154, 155, 362/156, 190, 191, 396

[56] References Cited

U.S. PATENT DOCUMENTS

| | | | |
|---|---|---|---|
| 2,285,454 | 6/1942 | Moss | 362/155 |
| 2,534,179 | 12/1950 | Peterson et al. | 362/190 |
| 2,755,688 | 12/1956 | Golden | 362/191 |
| 2,774,860 | 12/1956 | Prebol et al. | 362/191 |
| 2,827,559 | 3/1958 | Hoffman | 362/155 |
| 4,423,473 | 12/1983 | Kirkley | 362/191 |
| 5,444,605 | 8/1995 | Rivera | 362/156 |

*Primary Examiner*—Thomas M. Sember

*Attorney, Agent, or Firm*—Dorothy S. Morse

[57] ABSTRACT

A small, lightweight, battery-powered lighting device which can be attached to the upper edge of a divider in a purse or a briefcase for use by a person needing to view and/or easily access items in the interior thereof. The device would have a substantially horseshoe-shaped elongated housing configured to hold two batteries in an end-to-end relation within an upper battery compartment having a circular cross section only minimally larger in diameter than the size of battery contemplated for use. It also would have a lower light compartment with sides that taper toward an elongated focusing lens attached across the bottom edges of the housing, two spaced-apart clips attached against the outside surface of the housing and downwardly extending toward the lens, and an on-off switch connected through the end of the battery compartment toward which the positive terminals of the batteries are directed. The clips optionally could be configured to provide slight rotation of the housing relative to the clips to allow the user a choice of at least two housing orientations for directional control of the projected beam of light within the bottom of the briefcase or purse. Applications may include, but are not limited to, attachment to belts, clothing, straps, purses, travel bags, camera bags, sports bags, and briefcases.

19 Claims, 2 Drawing Sheets

POCKET LIGHT

This is a continuation-in-part of patent application Ser. No. 08/991,274 filed on Oct. 21, 1997, now abandoned.

BACKGROUND—FIELD OF INVENTION

This invention relates to lighting devices, specifically to a small, lightweight, battery-powered lighting device which can be attached to the upper edge of a divider in a purse or a briefcase for use by a person needing to view and/or easily access items in the interior thereof The preferred embodiment of the device would have a substantially horseshoe-shaped elongated housing configured to hold two batteries in an end-to-end relation within an upper battery compartment having a circular cross section only minimally larger in diameter than the size of battery contemplated for use. It also would have a lower light compartment with sides tapering toward an elongated light-focusing lens attached across the bottom edges of the housing, two spaced-apart clips attached to the housing against its outside surface and extending downwardly toward the lens, and an on-off switch connected through the end cap which seals the end of the battery compartment toward which the positive terminals of the batteries are directed. The clips optionally could be configured to provide slight rotation of the housing relative to the clips to allow users a choice of at least two housing orientations for directional control of the projected beam of light within the interior of the briefcase or purse. Applications may include, but are not limited to, attachment to belts, clothing, straps, purses, travel bags, camera bags, sports bags, and briefcases.

BACKGROUND—DESCRIPTION OF PRIOR ART

There are many situations which require a person to locate papers and items in the interior of a briefcase, purse, or travel bag under inadequate lighting conditions. For example, a person in a meeting or seminar may want to discretely refer to a document previously placed in a briefcase, and may be unable to do so without disturbing the people sitting nearby if the lights in the room have been dimmed for a video or slide presentation. Further, people carrying a purse or travel bag who for safety considerations need to gain prompt entrance into an automobile or a building in a poorly lit area at night would benefit from the use of a small easily transported lighting device that could be attached to the upper edge of a divider in the purse or travel bag and used to find keys which have not remained or been placed in expected positions. The present invention would provide a compact lightweight device for projecting a hands-free broad beam of light downwardly into the pocket of a briefcase, purse, or travel bag so that its user can employ both hands to promptly locate and retrieve a needed item therefrom or discretely view a needed item while it remains in the briefcase, purse, or bag. No lighting device is known which provides all of the advantages of the present invention for accomplishing such purposes.

SUMMARY OF INVENTION—OBJECTS AND ADVANTAGES

It is the primary object of this invention to provide an elongated lighting device which a user can employ to direct a broad hands-free beam of light into the interior pocket of a purse, travel bag, or briefcase for quick and easy retrieval of items therein. It is also an object of this invention to provide a pocket light which a user can employ to direct a broad hands-free beam of light into the interior of a briefcase to view papers therein under lighting conditions which would otherwise be inadequate for such a purpose. It is a further object of this invention to provide a pocket light which is compact in design and lightweight. A further object of this invention is to provide a pocket light with a housing configured to hold two standard sized AA or AAA batteries in an end-to-end relation within a battery compartment having a circular cross section only minimally larger in diameter than the size of battery contemplated for use. It is a further object of this invention to provide a pocket light which would have a light compartment that concentrates and focuses incandescent light toward an elongated lens positioned through and extending substantially across its bottom surface. It is also an object of this invention provide a pocket light which projects light only through its lens. A further object of this invention is to provide a reusable pocket light with a light compartment having removable end covers configured for easy replacement of its light bulbs. It is also an object of this invention to provide a pocket light which would have clips that could optionally be configured to allow the user a choice of at least two housing orientations for directional control of the beam of light within the interior of a briefcase, purse, or travel bag. A further object of this invention is to provide a pocket light with an on-off switch located on one of its ends for quick and easy activation. It is also an object of this invention to provide a lighting device which is designed for cost effective manufacture either as a reusable or a disposable unit.

As described herein, properly manufactured and installed upon the upper edge of a divider in a briefcase, purse, or travel bag, the present invention would provide a small, lightweight hands-free device which could project a focused beam of light downwardly into a compartment or pocket in the briefcase or bag adjacent to the divider. The present invention would have a substantially horseshoe-shaped elongated housing with a narrow light-focusing lens positioned across the bottom edges of the housing and extending substantially the fall length of the housing to provide a broad beam of light. The housing would contain separate battery and light compartments, with the upper battery compartment being only minimally larger in diameter than the size of the batteries intended for use. For most contemplated purposes either two standard sized AA batteries or two standard sized AAA batteries would be used as a power source, with the housing designed to accommodate two AA batteries being slightly larger in diameter than the housing designed to accommodate two AAA batteries. The compact design of the housing and the use of only two batteries would help to make the present invention lightweight and convenient to transport. Also for most contemplated purposes, the lower light compartment of the present invention would have two spaced-apart incandescent light bulbs positioned between an elongated reflector and the lens. The reflector would extend substantially the full length of the housing. The reflector and the tapering sides of the light compartment would enhance the amount of light directed through the lens. Although not critical, the light bulbs could be permanently attached to the reflector so that reflector and bulbs may be installed or removed as a single unit for convenient bulb replacement. The unit as a whole could then be replaced or the bulbs could be made detachable for individual replacement. In reusable embodiments the battery compartment would have two opposed removable end caps and the light compartment would have two opposed removable end covers, with the housing, the end caps, and the end covers all being made from opaque material. Although not critical, it is contemplated for the end caps used to seal the ends of the battery compartment in preferred reusable embodiments to have a threaded means of connection to the housing and for the end covers used for the light compartment to have three sides and a bottom portion with a recessed upper edge on its front surface that would allow an adjacent portion of a threaded end cap to secure the light compartment end cover in position during use. In the alternative, disposable embodiments with permanently attached opaque end caps and end covers are also contemplated. The housings of disposable embodiments would be made from plastic while the housings of preferred reusable embodiments would be made from either plastic or aluminum. To give the housing a thin profile, the batteries in the preferred embodiment would be placed into the housing in an end-to-end relation with the exposed positive terminal in contact with an on-off switch in one of the end caps. Since it projects a broad beam of light, the present invention is able to be positioned upon the upper edge of a bag divider and provide adequate light for the items being viewed. Since the housing would be made from lightweight materials, it is contemplated that two clips attached to the housing would be sufficient to secure the present invention upon the upper edge of a briefcase, purse, or travel bag divider for most purposes. The clips could be fixedly attached to the outside surface of the housing, or the clips could optionally be configured to allow slight rotation of the housing relative to the clips and offer its user a choice of at least two housing orientations for directional control of the beam of light directed toward a targeted location in the interior of a briefcase, purse, or travel bag. A preferred means of adjustably attaching the clips to the housing would cause the proximal end of each clip to slide within the housing and have at least two stops to temporarily secure the clips in a fixed position relative to the housing during use. The clips would also be configured so that the pocket light could be conveniently attached to a divider in the upper half of an open bi-folding briefcase which is positioned approximately perpendicular to its bottom half, and the broad beam of light projected downwardly from the elongated lens variably directed into the bottom half for optimal hands-free illumination of items therein. Further, the location of the on-off switch on one of its end caps makes activation of the pocket light fast and convenient, with a light source to power source electrical connection configured for simplified manufacture.

The description herein provides preferred embodiments of the present invention but should not be construed as limiting the scope of the pocket light invention. For example, variations in the length and diameter of the housing, the material from which the housing is made, the size of batteries used, the type of incandescent light bulbs used, the material from which the reflector is made, the type of on-off switch used, and the connection means used for attaching the end caps and end covers to the housing, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
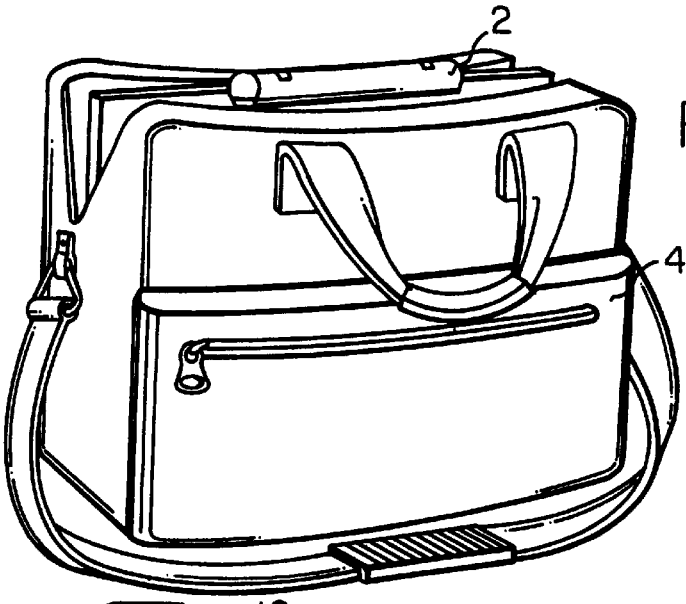
FIG. 1 is a perspective view of the present invention attached to the upper edge of a divider in a soft-sided briefcase or multi-compartmented travel bag.

FIG. 1 shows a preferred embodiment of the elongated lighting device 2 of the present invention being attached over the upper edge of a divider in a soft-sided briefcase 4. In such a position it is contemplated for a broad beam of light (not shown) to be projected downwardly through the bottom surface of lighting device 2 into a pocket or compartment (not shown) in briefcase 4 adjacent to the divider. In the preferred embodiment, light would only be projected through the bottom of lighting device 2 but directional control of the light beam could be optionally made possible through simply made changes in housing orientation relative to the divider in briefcase 4. Depending upon the depth and width dimensions of briefcase 4 as well as the location of the items (not shown) within briefcase 4 to which a user of lighting device 2 would need access, lighting device 2 could be positioned as shown in FIG. 1 to project light centrally within briefcase 4 or alternatively positioned near to one of the ends of briefcase 4. Also, although not shown, it is equally contemplated for lighting device 2 to be clipped onto a divider in the upper half of a bi-folding briefcase (not shown) that is in an opened position with its upper half in a position approximately perpendicular to its bottom half so that a broad beam of light could then be projected through the bottom surface of lighting device 2 onto items in the bottom half of the bi-folding briefcase. It is contemplated for lighting device 2 to be made from lightweight materials, such as aluminum or plastic, and be compact in design for easy transport, as well as being thin in profile so as not to block access to, or viewing of, needed items (not shown) within the interior of briefcase 4.

Figure 2:
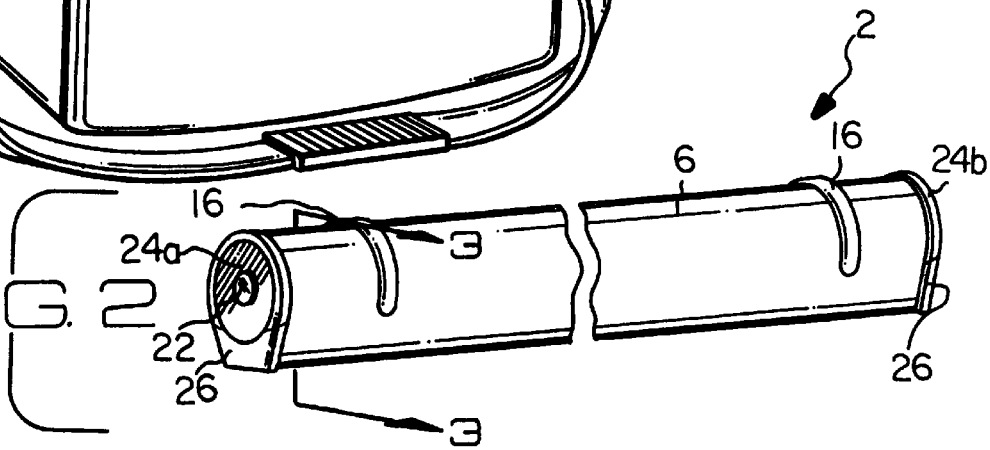
FIG. 2 is a perspective view of the present invention having two clips and an on-off switch positioned through one of its battery compartment end caps.

FIG. 2 shows a preferred embodiment of lighting device 2 having an elongated housing 6 with a substantially horseshoe-shaped cross-sectional configuration. In the preferred embodiment it is contemplated for both ends of housing 6 to have an identical dimension and configuration. FIG. 2 also shows housing 6 having two spaced-apart clips 16 positioned over the top of housing 6 and extending approximately two-thirds of the distance down the back of housing 6 to allow housing 6 to hang securely in a vertical position from the upper surface of a thin object, such as the compartment divider in a briefcase 4, or a belt or strap (not shown). Although not shown, lighting device 2 could also be positioned over the upper edge of a work apron or article of clothing to provide hands-free lighting for items in a person's lap or on a work surface in front of them. When in such a position, a broad beam of light (not shown) would be projected downwardly from the tapered bottom surface of horseshoe-shaped housing 6 into the interior of briefcase 4, or onto the lap or other work surface. Although the number of clips 16 is not critical, since it is contemplated for housing 6 to be made from lightweight materials, for most purposes two clips 16 are adequate to secure housing 6 in place during use. In addition, FIG. 2 shows battery compartment ends caps 24*a* and 24*b*, as well as two light compartment end covers 26, positioned against the opposite ends of housing 6 to close them, each end of housing 6 having one end cover 26 and one end cap, either 24*a* or 24*b*. End cap 24*a* is shown having an on-off switch 22 centrally located therethrough and is contemplated for placement against the exposed positive terminal of batteries 18. It is contemplated for the scope of the present invention to include both reusable embodiments in which end caps 24*a* and 24*b*, as well as end covers 26, would be removable, and disposable embodiments in which end caps 24*a* and 24*b* and end covers 26 would be permanently attached to housing 6. The materials from which housing 6, end caps 24*a* and 24*b*, end covers 26, and clips 16 are made is not critical, however it is contemplated that lighting device 2 be lightweight for convenient transport and use. In the preferred embodiment, housing 6 would be made from a lightweight opaque plastic material or aluminum. Also, clips 16 must be made from materials that will not easily become fatigued by repeated manipulation during attachment and detachment from briefcase 4 during routine use. It is also contemplated that housing 6, end caps 24*a* and 24*b*, and end covers 26 all be made from opaque materials. FIG. 2 also shows end cap 24*a* having a circular configuration and the upper surface of end cover 26 having a curvature complementing that of the perimeter of end cap 24*a* so that end cap 24*a* and end cover 26 together are able to seal the end of housing 6. Although not shown in FIG. 2, it is contemplated for end cap 24*b* and the end cover 26 on the opposed end of housing 6 to be identically configured, except that end cap 24*b* would not contain an on-off switch 22.

Figure 3:
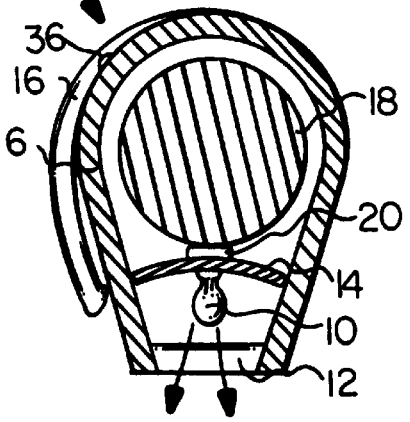
FIG. 3 is a sectional end view of the present invention having a battery positioned within its upper battery compartment and a reflector positioned between the battery and a light source, and also having a light-focusing lens positioned remote from the battery.

FIG. 3 shows lighting device 2 with a substantially horseshoe-shaped housing 6 and a lens 12 positioned between the bottom ends of housing 6. FIG. 3 also shows a light source 10 positioned adjacent to lens 12 with a reflector 14 positioned within housing 6 above light source 10 to help redirect upwardly emitted light (not shown) from light source 10 toward lens 12. FIG. 3 further shows a battery 18 positioned above reflector 14, with a copper strip 20 or other means of electrical connection available for completing an electrical circuit between battery 18 and light source 10. Although it is contemplated in some embodiments of lighting device 2 for clip 16 to have a fixed connection to housing 6, FIG. 3 shows housing 6 having a slight protrusion 36 configured to interface with an indentation (shown as number 34 in FIG. 4) on clip 16 to provide a temporary stop for adjustment of the orientation of housing 6 relative to clip 16 so that a user (not shown) would be able to directionally control the light beam projected through lens 12 onto an object (not shown) needing illumination. A slot (not shown) would be required through housing 6 to accommodate the sliding of clips 16 within housing 6 to slightly change the angle of light emitted through lens 12 relative to briefcase 4 for such directional control. More than one protrusion on housing 6 is contemplated. Although not shown, it is equally contemplated for protrusion 36 to be on clip 16 with a complementary indentation 34 formed into housing 6. In the preferred embodiment it is contemplated for the adjustment in position of housing 6 caused by movement of protrusion 36 between adjacent indentations 34 to be approximately one-eighth of an inch. Further, although not critical, it is contemplated for the distal end of clip 16 to be slightly thickened on the portion of its surface facing housing 6 for more secure engagement of the end of clip 16 against its supporting structure, such as a divider in briefcase 4.

Figure 4:
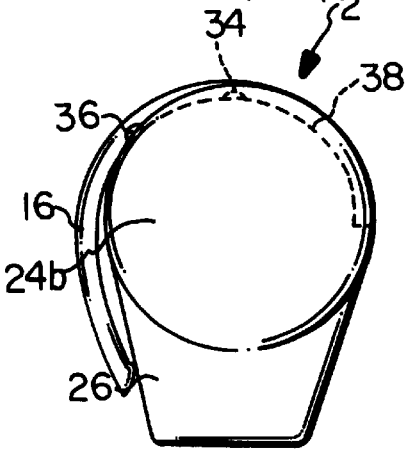
FIG. 4 is a sectional end view of the present invention having an adjustable clip attached through the outer surface of the housing.

FIG. 4 also shows an embodiment of lighting device 2 having an adjustable clip 16 for providing at least two changes in housing orientation relative to clip 16. FIG. 4 shows end cap 24*b* positioned above end cover 26 and presumably attached together over one end of housing 6, although housing 6 is not visible in FIG. 4. Protrusion 36 would be attached to a part of the outer surface housing 6 which faces clip 16 and clip 16 would have a complementary indentation 34 on the portion of its outer surface facing housing 6. Although not identified in FIG. 4, as it would not clearly be seen, a second indentation 34 would be present and positioned around protrusion 36 to function as a stop therefore to temporarily place housing 6 in a fixed position relative to clip 16. Thus, the embodiment of lighting device shown in FIG. 4 would allow clips 16 to be placed into two distinct positions relative to housing 6. FIG. 4 also shows clip 16 having an interior end 38 which would be permanently positioned within housing 6 to counterbalance the exposed portion of clip 16 and allow clip 16 to securely hold housing 6 against a support structure such as a divider in briefcase 4.

Figure 5:
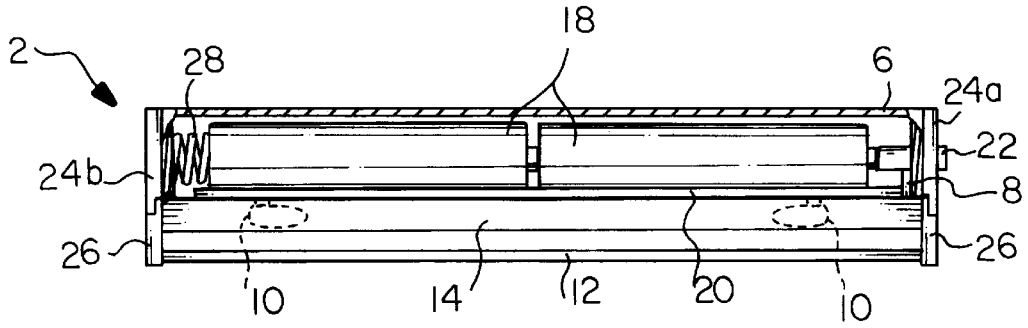
FIG. 5 is a sectional front view of the present invention having a housing containing two batteries, a reflector, two incandescent light sources, a light-focusing lens, and an on-off switch.

FIG. 5 shows lighting device 2 having an elongated housing 6 with a length slightly longer than the two batteries 18 positioned therein in an end-to-end relation. To achieve a compact overall configuration, it is contemplated for batteries 18 to substantially fill the upper battery compartment within housing 6. FIG. 5 also shows a compression spring 28 positioned between battery end cap 24*b* and the exposed negative terminal of batteries 18. Although the number of batteries 18 used is not critical to lighting device 2, in the preferred embodiment the number of batteries 18 is limited to two AA or AAA batteries 18 so that lighting device 2 remains lightweight and easy to transport. FIG. 5 also shows lighting device 2 having elongated reflector 14 positioned between batteries 18 and lens 12, as well as two spaced apart incandescent light sources 10 which together create the broad beam of light (not shown) projected through lens 12 when on-off switch 22 is activated. End caps 24*a* and 24*b* help to keep batteries 18 within the upper circular battery compartment portion of housing 6, while opposed end covers 26 help to retain reflector 14 and light sources 10 within the lower light compartment portion of housing 6. Although not critical, in the preferred reusable embodiments, for rapid and convenient replacement of light sources 10 it is contemplated for light sources 10 to be attached to reflector 14 so that reflector 14 and light sources 10 can be removed as a single unit from housing 6. One means of attachment would consist of light sources 10 being pressed into sockets (not shown) in reflector 14. FIG. 5 also shows end caps 24*a* and 24*b* overlapping end covers 26 and being used in part to hold end covers 26 in place against housing 6. FIG. 5 further shows end cap 24*a* having an on-off switch 22 with an interior portion that remains in contact with the exposed positive terminal of batteries 18. In the preferred embodiment to complete the electrical circuit for operation of lighting device 2, a connecting piece 8 made from electrically conductive material is connected between switch 22 and a copper strip 20 positioned between light sources 10 and batteries 18. Activation of light sources 10 would then occur when switch 22 is depressed and an internal component (not shown) within switch 22 completes the electrical circuit between copper strip 20 and batteries 18. However, electrical connection using copper strip 20 and connecting piece 8 is not critical and it is also contemplated to have other means of electrical connection between light sources 10 and batteries 18.

Figure 6:
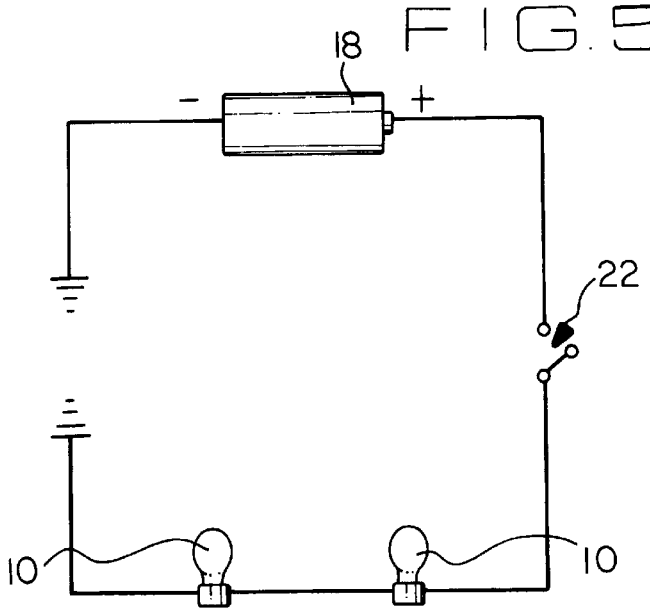
FIG. 6 is a schematic view of the electrical circuit of the present invention having two light sources, an on-off switch, and battery power.

FIG. 6 shows the electrical circuit used to activate the lighting sources 10 of the preferred embodiment of lighting device 2, even though more complex electrical circuit configurations are also within the scope of the present invention. FIG. 6 shows light sources 10 connected to a direct current power source, at least one battery 18, with a switch 22 being positioned therebetween to control flow of electrical power from battery 18 to light sources 10. Although FIG. 6 shows light sources 10 connected in series, it is also contemplated for light sources 10 to be connected in parallel so that if one light source burned out the other might still be able to function. In the preferred embodiment batteries 18 and switch 22 remain in contact with one another, with the electrical circuit not becoming a closed loop until an internal component (not shown) in switch 22 becomes activated.

Figure 7:
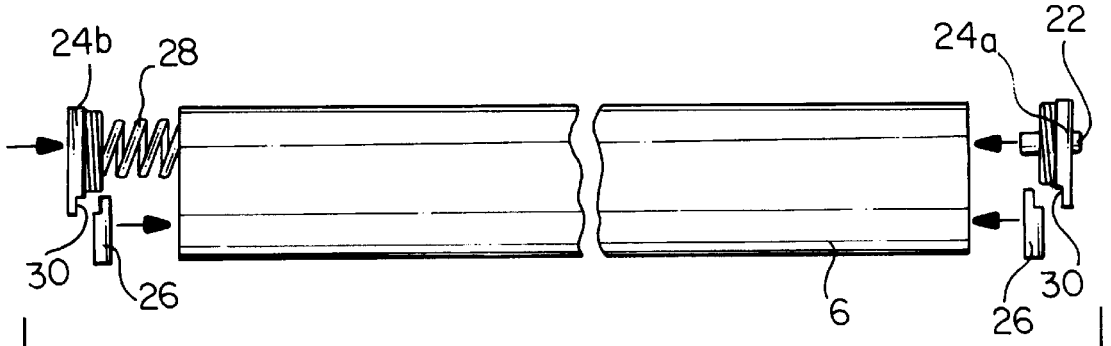
FIG. 7 is an exploded front view of the present invention having opposed end caps and end covers for both the battery compartment and the light compartment, respectively, with the light compartment end covers each having a cut-out on its upper edge so that it can be secured in place in part by the threaded end cap of the battery compartment.

FIG. 7 shows end cap 24*a* with on-off switch 22 poised for connection to one end of housing 6 with a portion of end cap 24*a* having a cutout 30 overlapping 26 to hold it in place against housing 6 during use. FIG. 7 also shows end cap 24*b* poised for connection to the opposite end of housing 6 and engagement with spring 28 to cause spring 28 to become positioned within housing 6 against batteries 18 to bias them toward contact with the internal portion of on-off switch 22. FIG. 7 also shows a portion of end cap 24*b* having cutout 30 overlapping 26 to hold it in place against housing 6 during use. It is contemplated for end caps 24*a* and 24*b* to close the ends of the battery compartment of housing 6 to keep batteries 18 in proper position during use and for end covers 26 to seal the ends of the light compartment of housing 6 so as to retain reflector 14 and light sources 10 in their proper positions during use. Although in the preferred embodiment end caps 24*a* and 24*b* have a threaded engagement with housing 6, and end covers 26 snap-fit over the end of housing 6, to be further secured in place by either end cap 24*a* or 24*b*, it is considered within the scope of the present invention to provide for other means of connection between housing 6 and end cap 24*a*, end cap 24*b*, and end covers 26.

Figure 8:
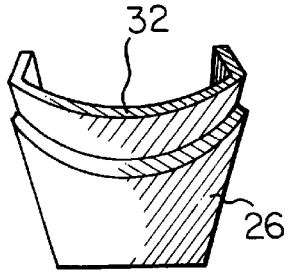
FIG. 8 is a front view of a preferred embodiment of the three-sided light compartment end cover of the present invention having a curved and recessed upper edge and sides which downwardly taper away from the curved upper edge.

FIG. 8 shows the preferred embodiment of end cover 26 being three-sided and having a curved upper edge 32 configured to complement the curvature of the circular perimeters of end caps 24*a* and 24*b*. End cover 26 is also shown to have a downwardly tapering configuration. In the preferred embodiment curved upper edge 32 would also have a recessed part intended to slide under cutout 30 in threaded end caps 24*a* and 24*b* so that end caps 24*a* and 24*b* help to retain end covers 26 in position against housing 6. In reusable embodiments of lighting device 2 end covers 26 and end caps 24*a* and 24*b* would remain separable entities. However, in disposable embodiments of lighting device 2 it is contemplated for end covers 26 as well as end caps 24*a* and 24*b* to remain separable entities, or to be merged into a single end closure (not shown) having the combined configuration of end cover 26 and either end cap 24*a* or 24*b*. As previously mentioned, it is contemplated for end covers 26 to be made from the same opaque material used to make housing 6.

To use lighting device 2 to view the interior of a briefcase or travel bag, a person would use one hand to lift housing 6 and force fit clips 16 over the upper edge of a divider in a multi-compartmented travel bag or briefcase 4 so that the divider is firmly positioned between housing 6 and both clips 16. The incandescent light sources 10 of lighting device 2 could then be easily and readily activated by a user (not shown) depressing switch 22. Upon closure of the circuit between batteries 18 and light sources 10 through activation of switch 22, transfer of electrical power to light sources 10 would cause a broad beam of light to be projected downwardly through lens 12. Light upwardly emitted by light sources 10 would be redirected toward lens 12 by reflector 14. The tapering sides of the horseshoe-shaped housing 6 would also help to maximize the amount of light directed through the narrow but elongated lens 12. When lighting device 2 is no longer needed, switch 22 can again be easily and readily depressed to interrupt the circuit connection. Lighting device 2 can then be removed by a user from the divider in briefcase 4 by simply grasping housing 6 with one hand and applying a force to lift housing 6 away from the divider. Replacement of batteries 18 is accomplished by removal of either end cap 24*a* or 24*b*, removal of spent batteries 18, and subsequent insertion of fresh batteries 18 within the battery compartment followed by replacement of end cap 24*a* or 24*b*. Replacement of one or both light sources 10 is achieved by loosening or removal of one end cap, 24*a* or 24*b*, and removal of its adjacent end cover 26. When light sources 10 are attached to reflector 14, light sources 10 and reflector 14 can be conveniently removed as a single unit from the light compartment within housing 6. It is also contemplated that removal of end covers 26 may be accomplished in some preferred embodiments by simply loosening end caps 24*a* and 24*b*, without actually removing them completely to release end cover 26, end covers 26 then being able to be angled for removal from their usable positions. Replacement of end covers 26 would be accomplished by angling its recessed upper edge under cutout 30 and, after snap fitting end cover 26 in position, tightening end caps 24*a* and 24*b* against end caps 26 to securely close both the battery compartment and lighting compartment of housing 6. When an embodiment of lighting device 2 is used having adjustable clips 16, once housing 6 is attached to the upper edges of a divider in briefcase 4, a user (not shown) can change the orientation of housing 6 relative to clips 16 by slightly rotating housing 6 and inserting protrusion 36 into a next adjacent one of several closely spaced apart indentations 34 to slightly redirect the beam of light (not shown) being projected from lens 12 for better illumination of a targeted object (not shown) within briefcase 4.

What is claimed is:

1. A lighting device for attachment to an upper edge of a thinly configured support structure for hands-free use in illuminating objects adjacent to the support structure, said lighting device comprising an elongated opaque housing configured to hold a plurality of batteries in an end-to-end relation, said housing having a substantially horseshoe-shaped cross-sectional configuration and opposed bottom edges, said housing also having an upper battery compartment and a light compartment positioned below said battery compartment, said battery compartment and said light compartment each having opposed open ends;

an elongated light-focusing lens positioned and secured between said opposed bottom edges;

a plurality of batteries positioned within said housing and substantially filling said battery compartment, each of said batteries having a positive terminal and a negative terminal, said positive terminal of adjacent ones of said batteries being in contact with a negative terminal of the next adjacent one of said batteries;

a plurality of incandescent light sources spaced apart within said light compartment of said housing a sufficient distance from one another to provide a broad beam of focused light through said lens upon activation of said light sources;

an elongated reflector positioned between said batteries and said lens, said reflector extending substantially a full length of said housing, said reflector having an arcuate configuration adapted to maximally reflect light projected by said light sources toward said lens;

electrical connection means adapted for connecting each of said light sources to said batteries;

a plurality of clips connected to said housing and extending downwardly toward said lens;

a pair of end caps configured for sealing said opposed open ends of said battery compartment of said housing and being connected to said housing;

a pair of end covers configured for sealing said opposed open ends of said light compartment of said housing and being connected to said housing; and an on-off switch connected through the one of said end caps in a position opposed to an exposed one of said positive terminals of said batteries so that upon engagement of said switch an electrical circuit is completed to allow sufficient power to be drawn from said batteries for activation of said light sources and illumination of objects adjacent to the support structure to which said housing is attached.

2. The lighting device of claim 1 further comprising two of said batteries, two of said light sources, and two of said clips.

3. The lighting device of claim 1 further comprising a spring to bias said batteries toward said switch.

4. The lighting device of claim 1 wherein said end caps are configured and positioned to help retain said end covers against said housing.

5. The lighting device of claim 1 wherein said clips are configured to provide more than one fixed orientation between said housing and said clips.

6. The lighting device of claim 5 wherein said clips each have a proximal end and said proximal end slides within said housing during changes in orientation between said housing and said clips.

7. The lighting device of claim 6 further comprising at least one protrusion and a plurality of complementing indentations for use in temporarily securing said housing in different orientations relative to said clips.

8. The lighting device of claim 1 wherein said on-off switch comprises at least one push button type of on-off switch.

9. The lighting device of claim 1 wherein said end caps have threaded means for secure attachment to said housing.

10. A lighting device for attachment to an upper edge of a divider in briefcases, travel bags having multiple compartments, and purses for hands-free use in illuminating objects placed within a compartment adjacent to the divider, as well as illumination of objects in an opposed portion of a bi-folding briefcase, said lighting device comprising an elongated opaque housing configured to hold a plurality of batteries in an end-to-end relation, said housing having a horseshoe-shaped cross-sectional configuration and opposed bottom edges, said housing also having an upper battery compartment and a light compartment positioned below said battery compartment, said battery compartment and said light compartment each having opposed open ends;

an elongated light-focusing lens positioned and secured between said opposed bottom edges;

two batteries positioned within said housing and substantially filling said battery compartment, each of said batteries having a positive terminal and a negative terminal, said positive terminal of one of said batteries being in contact with said negative terminal of the other of said batteries;

two incandescent light sources spaced apart within said light compartment of said housing a sufficient distance from one another to provide a broad beam of focused light through said lens upon activation of said light sources;

an elongated reflector positioned between said batteries and said lens, said reflector extending substantially a full length of said housing, said reflector having an arcuate configuration adapted to maximally reflect light projected by said light sources toward said lens;

electrical connection means adapted for connecting each of said light sources to said batteries;

a plurality of clips connected to said housing and extending downwardly toward said lens;

a pair of end caps configured for sealing said opposed open ends of said battery compartment of said housing and being connected to said housing;

a pair of end covers configured for sealing said opposed open ends of said light compartment of said housing and being connected to said housing; and a depressible on-off switch connected through the one of said end caps in a position opposed to an exposed one of said positive terminals so that upon engagement of said switch an electrical circuit is completed to allow sufficient power to be drawn from said batteries for activation of said light sources and illumination of said objects.

11. The lighting device of claim 10 further comprising two of said clips.

12. The lighting device of claim 10 further comprising a spring to bias said batteries toward said switch.

13. The lighting device of claim 10 wherein said end caps are configured and positioned to help retain said end covers against said housing.

14. The lighting device of claim 10 wherein said clips are configured to provide more than one fixed orientation between said housing and said clips.

15. The lighting device of claim 14 wherein said clips each have a proximal end and said proximal end slides within said housing during changes in orientation between said housing and said clips.

16. The lighting device of claim 15 further comprising at least one protrusion and a plurality of complementing indentations for use in temporarily securing said housing in different orientations relative to said clips.

17. The lighting device of claim 10 wherein said end caps have threaded means for secure attachment to said housing.

18. A method of lighting an inside surface of briefcases, travel bags, and purses, said method comprising the steps of providing an elongated opaque housing having a horseshoe-shaped cross-sectional configuration, opposed lower edges, and opposed open ends; an elongated light-focusing lens; a plurality of batteries; a plurality of incandescent light sources; an elongated reflector; electrical connection means; a plurality of clips; a pair of end caps with one of said end caps having an on-off switch therethrough; and a pair of end covers;

positioning said lens between said opposed lower edges;

positioning one of said end covers over a portion of said housing adjacent to said lower edges;

placing said end cap having said on-off switch over a portion of said housing not sealed by said end cover as well as a sufficient amount of said end cover already attached to said housing to help maintain said end cover against said housing during use of said lighting device;

positioning said batteries within said housing so that each of said batteries is oriented in the same direction and with a positive battery end positioned adjacent to said switch;

connecting said incandescent light sources in a spaced-apart configuration to said reflector;

positioning said reflector within said housing between said batteries and said lens;

electrically connecting each of said light sources to said batteries;

connecting the other one of said end caps and said end covers to the other of said opposed ends of said housing;

tightening said end caps and said end covers against said housing; and connecting said clips to said housing so that said clips extend downwardly toward said lens and upon engagement of said switch an electrical circuit is completed to allow sufficient power to be drawn from said batteries for activation of said light sources and illumination of objects within a bag to which it is attached.

19. The method of claim 18 further comprising the steps of providing adjustable clips and connecting said clips to said housing so that said housing can be rotated slightly into at least two alternative orientations relative to said clips.

* * * * *